United States Patent [19]

Seligmann

[11] 4,314,507

[45] Feb. 9, 1982

[54] SEQUENTIAL INITIATION OF EXPLOSIVES

[75] Inventor: Peter C. Seligmann, Johannesburg, South Africa

[73] Assignee: AECI Limited, Johannesburg, South Africa

[21] Appl. No.: 34,133

[22] Filed: May 14, 1979

[51] Int. Cl.[3] ..... F42C 11/06; F42D 1/00

[52] U.S. Cl. ..... 102/217; 361/249

[58] Field of Search ..... 102/217, 206, 200, 23, 102/22 R; 361/249, 248

[56] References Cited

U.S. PATENT DOCUMENTS

| | | | |
|---|---|---|---|
| 3,312,869 | 4/1967 | Werner | 102/217 |
| 3,468,255 | 9/1969 | Stryker, Jr. | 102/217 |
| 3,571,605 | 3/1971 | Dobson et al. | 102/217 |

FOREIGN PATENT DOCUMENTS

| | | | |
|---|---|---|---|
| 8367 | 11/1973 | South Africa | 102/217 |
| 8368 | 11/1973 | South Africa | 102/217 |

*Primary Examiner*—Charles T. Jordan

*Attorney, Agent, or Firm*—Cushman, Darby & Cushman

[57] ABSTRACT

A circuit for use in the sequential initiation of explosives comprises an up-down counter having a first input terminal at which an up-count is initiated, a second input terminal at which a downcount is initiated, and an output terminal, an energy storage capacitor for powering the counter, a first resistor which has a low impedance for a fixed time to current of a particular value and of a first polarity and which thereafter has a high impedance connected to one of the input terminals of the counter so that when current of the first polarity and of the particular value is passed through the first resistor a signal is applied after the fixed time to the input terminal to initiate a count in an up direction, and a second resistor which has a low impedance to a predetermined voltage of a given polarity connected to the other input terminal of the counter so that when the predetermined voltage of the given polarity is applied to the second resistor a count is initiated in a down direction, the counter generating an output signal at its output terminal for actuating a detonator when the count in the down direction reaches zero.

8 Claims, 1 Drawing Figure

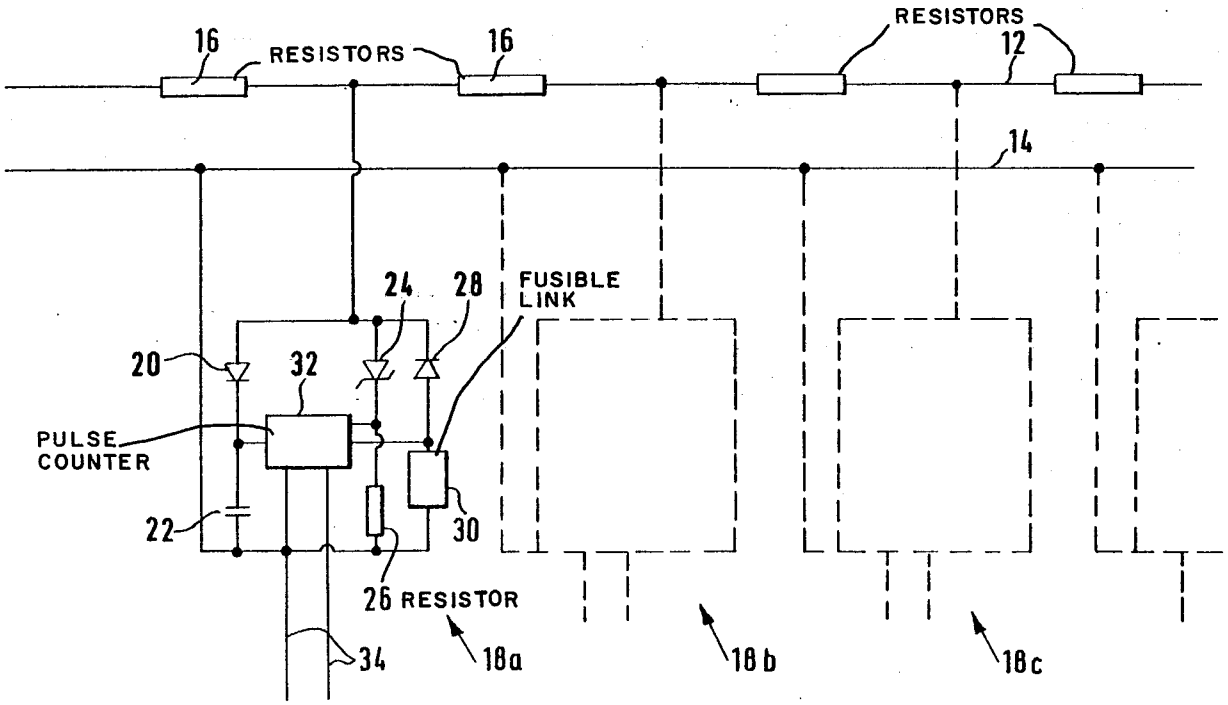
RESISTORS
12
14
18c
18b
FUSIBLE LINK
16
28
30
18a
RESISTOR
24
26
34
RESISTORS
32
16
20
22
PULSE COUNTER

SEQUENTIAL INITIATION OF EXPLOSIVES

This invention relates to a system for the sequential initiation of explosives and to a circuit for use in the system.

In certain aspects of mining practice it is desirable to initiate numerous charges of explosives in succession with accurately controlled time intervals between successive explosions.

It is accordingly an object of the invention to provide an electrical circuit for use in the sequential initiation of explosives A circuit according to the invention comprises:

up-down counter means having a first input terminal at which an up-count is initiated, a second input terminal at which a down-count is initiated and an output terminal, energy storage means for powering the counter means, first impedance means which has a low impedance for a fixed time to current of a particular value of a first polarity and which thereafter has a high impedance connected to one of the input terminals of the counter means so that when current of the first polarity and of the particular value is passed through the first impedance means a signal is applied after the fixed time to the input terminal to initiate a count in a first direction, and second impedance means which has a low impedance to a predetermined voltage of a given polarity connected to the other input terminal of the counter means so that when the predetermined voltage of the given polarity is applied to the second impedance means a count is initiated in a second direction opposite to the first direction, the counter means generating an output signal at its output terminal for actuating a detonator device when the count in the second direction reaches a predetermined value.

It is a further object of the invention to provide a system for the sequential initiation of explosives.

A system according to the invention comprises:

first and second electrical conductors, a plurality of impedances connected in series in the first electrical conductor, and a plurality of switching circuits, each switching circuit being connected between the junction of two adjacent impedances and the second electrical conductor and comprising:

up-down counter means having a first input terminal at which an up-count is initiated, a second input terminal at which a down-count is initiated and an output terminal, means to store energy applied to the conductors, the stored energy being used to power the counter means, each switching circuit being so arranged that when the pulses of a given polarity and magnitude are applied between the electrical conductors signals are applied to one of the input terminals of each of the counter means in succession thereby causing each counter means in succession to initiate a count in a first direction, and when a pulse of a given polarity and magnitude is applied between the electrical conductors a signal is applied simultaneously to the other input terminal of each of the counter means thereby causing each counter means to initiate a count in a second direction opposite to the first direction, a detonator device being connected to the output terminal of each counter means and each counter means generating a signal at its output terminal to actuate its detonating device when it reaches a zero count.

The invention is also intended to extend to:

A method of sequentially initiating explosives which includes the steps of initiating a count in a first direction for each of the explosives in succession and, once counts have been initiated for all the explosives, reversing each count, and as each count reaches a predetermined value, initiating the explosion of the respective explosive.

The invention is further described by way of example with reference to the accompanying drawing, which illustrates part of a sequential blasting system according to the invention.

Referring to the drawing, a blasting system according to the invention includes first and second electrical conductors 12 and 14 respectively, a number of resistors 16 connected in electrical series in the first electrical conductor, and a number of switching circuits 18A, 18B, 18C . . . , each circuit being connected between the junction of two adjacent resistors and the conductor 14.

Each circuit includes a diode 20 and storage capacitor 22, a zener diode 24 and resistor 26, a diode 28 and a fusible link 30, and an up-down electronic clock pulse counter 32. A detonating device (not shown) is connected to the output terminal 34 of the counter.

In use of the system, the conductor 12 is made positive with respect to the conductor 14 and the storage capacitors 22 of all the circuits are charged via the diodes 20. Assume that the charging voltage is applied on the left hand end of the conductors. The capacitors on the right charge more slowly than those on the left but eventually all the capacitors are charged and no current is drawn from the voltage source. When this happens, constant-current pulses are applied to the line such that the conductor 12 is negative with respect to the conductor 14. The fusible link 30 of each circuit is chosen to present a low impedance to the negative pulses for a fixed time, say 15 ms$\pm$3 ms at a particular value of current.

With the first pulse the link 30 of the left most circuit, 18A, fuses, or open circuits, a few milliseconds before the end of the pulse, and therefore presents a high impedance to the pulse on the conductors. Because of the resistors 16 the current through the fusible link 30 of the circuit 18B is small and has no effect on the link. Also when the link in the circuit 18A open circuits the remainder of the pulse is of insufficient duration to have an effect on the link in the circuit 18B. When the impedance of the link in the circuit 18A rises, the voltage across the link increases and an up-count in the counter 32 is initiated.

The next negative pulse on the line triggers the second circuit 18B and starts its counter one interval later, and so on. When all the circuits have been triggered, signalled by a rise in impedance of the system, a large negative spike is applied to the conductor 12. This pulse overcomes all the zener diodes 24 in parallel and a negative pulse is applied to each of the counters to initiate a reversal of the direction of count. When the count at each circuit reaches zero, its detonator is fired. Immediately after the negative spike the conductor 12 can be made positive with respect to the conductor 14 and supply some charging current to each of the capacitors 22.

The detonators are fired in the reverse sequence to which the respective counters are energized.

The energy necessary to fire each detonator is derived from its storage capacitor 22 which also serves to power the counter 32.

The fusible link 30 may in its simplest form consist of a suitable piece of fuse wire. Alternatively it may be a fusehead or any other suitable device.

To avoid packaging the individual circuits these may be miniaturised and enclosed inside the casing of each detonator.

Alternatively the circuits may be separately encased in suitable housings and subsequently be connected to the detonators.

I claim:

1. A circuit for use in the sequential initiation of explosives comprising up-down counter means having a first input terminal at which an up-count is initiated, a second input terminal at which a down-count is initiated and an output terminal, energy storage means for powering the counter means, first impedance means which has a low impedance for a fixed time to current of a particular value and of a first polarity and which thereafter has a high impedance connected to one of the input terminals of the counter means so that when current of the first polarity and of the particular value is passed through the first impedance means a signal is applied after the fixed time to the input terminal to initiate a count in a first direction, and second impedance means which has a low impedance to a predetermined voltage of a given polarity connected to the other input terminal of the counter means so that when the predetermined voltage of the given polarity is applied to the second impedance means a count is initiated in a second direction opposite to the first direction, the counter means generating an output signal at its output terminal for actuating a detonator device when the count in the second direction reaches a predetermined value.

2. A circuit as claimed in claim 1 wherein the first impedance means comprises a fusible link.

3. A circuit as claimed in claim 2 wherein the fusible link comprises a fuse wire or a fusehead.

4. A circuit as claimed in any one of claims 1 to 3 inclusive wherein the second impedance comprises a zener diode.

5. A circuit as claimed in any one of claims 1 to 3 inclusive wherein the circuit is miniaturised and enclosed inside a detonator casing.

6. A system for the sequential initiation of explosives, comprising:

first and second electrical conductors, a plurality of impedances connected in series in the first electrical conductor, and a plurality of switching circuits, each switching circuit being connected between the junction of two adjacent impedances and the second electrical conductor and comprising:

up-down counter means having a first input terminal at which an up-count is initiated, a second input terminal at which a down-count is initiated and an output terminal, means to store energy applied to the conductors, the stored energy being used to power the counter means, each switching circuit being so arranged that when a plurality of pulses of a first predetermined polarity and magnitude are applied between the electrical conductors, signals are applied to one of the input terminals of each of the counter means in succession, thereby causing each counter means in succession to initiate a count in a first direction, and when a pulse of a second predetermined polarity and magnitude is applied between the electrical conductors, a signal is applied simultaneously to the other input terminal of each of the counter means thereby causing each counter means to initiate a count in a second direction opposite to the first direction, a detonator device being connected to the output terminal of each counter means, and each counter means generating a signal at its output terminal to actuate its detonating device when it reaches a zero count.

7. A system for sequentially initiating explosive detonators, comprising:

first and second electrical conductors, a plurality of impedance elements connected in series with one another along the first electrical conductor, and a plurality of switching circuits, each switching circuit being connected between the junction of two adjacent impedance elements and the second electrical conductor and comprising:

an up-down counter having a first input for initiating an up-count, a second input for initiating a down-count, and an output terminal adapted for connection to an explosives detonator;

energy storage means for providing operating power to said counter;

first impedance means having a characteristic low impedance for a fixed time to current of a particular magnitude and of a first polarity passing therethrough and which thereafter has a characteristic high impedance, said first impedance means being connected to one of the input terminals of the counter so that when current of the first polarity and of the particular magnitude is passed through the first impedance means, a signal is applied after the fixed time to the input terminal to initiate a count in a first direction (up or down); and second impedance means having a characteristic low impedance to a predetermined voltage of a second polarity connected to the other input terminal of the counter so that when the predetermined voltage of the second polarity is applied to the second impedance means, a count is initiated in a second direction (down or up) opposite to the first direction (up or down), each switching circuit being so arranged that when a plurality of pulses of said first predetermined polarity and particular magnitude are applied between the first and second electrical conductors, signals are applied to one of the input terminals of each of the counters in succession thereby causing each counter in succession to initiate a count in said first direction, and when a pulse of said second polarity is applied between the first and second electrical conductors, a signal is applied simultaneously to the other input terminal of each of the counters thereby causing each counter to initiate a count in said second direction, the counter generating an output signal at its output terminal for actuating a detonator coupled thereto when the count in the second direction reaches a predetermined value.

8. A method of sequentially initiating explosives which includes the steps of initiating a count in a first direction for each of the explosives in succession and, once counts have been initiated for all the explosives, reversing each count, and as each count reaches a predetermined value, initiating the explosion of the respective explosive.

* * * * *